US008573812B2

(12) United States Patent
Joung et al.

(10) Patent No.: US 8,573,812 B2
(45) Date of Patent: Nov. 5, 2013

(54) ILLUMINATING DEVICE

(75) Inventors: Wuk Chul Joung, Daejeon (KR); Jin Woo Bae, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 85 days.

(21) Appl. No.: 13/285,673

(22) Filed: Oct. 31, 2011

(65) Prior Publication Data

US 2012/0176794 A1 Jul. 12, 2012

(30) Foreign Application Priority Data

Jan. 6, 2011 (KR) ..... 10-2011-0001443

(51) Int. Cl.
*F21V 29/00* (2006.01)

(52) U.S. Cl.
USPC ..... 362/294; 362/373; 362/646; 362/249.02

(58) Field of Classification Search
USPC ..... 362/249.02, 373, 294, 646
See application file for complete search history.

(56) References Cited

U.S. PATENT DOCUMENTS

| | | | | |
|---|---|---|---|---|
| 7,959,327 | B2 * | 6/2011 | Lai et al. | 362/294 |
| 8,029,158 | B2 * | 10/2011 | Chen | 362/249.02 |
| 8,070,318 | B2 * | 12/2011 | Chen | 362/249.02 |
| 8,226,272 | B2 * | 7/2012 | Chen | 362/294 |

FOREIGN PATENT DOCUMENTS

| | | | |
|---|---|---|---|
| KR | 10-2007-0077399 | A | 7/2007 |
| KR | 10-2008-0071812 | A | 8/2008 |
| KR | 10-2009-0077120 | A | 7/2009 |
| KR | 10-2009-0086482 | A | 8/2009 |

* cited by examiner

*Primary Examiner* — Anabel Ton
(74) *Attorney, Agent, or Firm* — McDermott Will & Emery LLP

(57) ABSTRACT

There is provided an illuminating device. The illuminating device includes a light source unit including a substrate and one or more light emitting devices mounted on the substrate, and a heat radiating unit including a sealed inner space into which a working fluid is injected, the working fluid being evaporated and condensed within the inner space due to heat of the light source unit, and emitting the heat of the light source unit to the outside through repeated phase changes according to evaporation and condensation of the working fluid.

11 Claims, 3 Drawing Sheets

ILLUMINATING DEVICE

CROSS-REFERENCE TO RELATED APPLICATIONS

This application claims the priority of Korean Patent Application No. 10-2011-0001443 filed on Jan. 6, 2011, in the Korean Intellectual Property Office, the disclosure of which is incorporated herein by reference.

BACKGROUND OF THE INVENTION

1. Field of the Invention

The present invention relates to an illuminating device.

2. Description of the Related Art

In general, in an illuminating device using a light emitting diode (LED), the quality of light and the lifespan of the illuminating device are affected by the operating temperature thereof. Therefore, maintaining an appropriate operating temperature may be a very important factor in view of the initial quality and long-term reliability of an LED illuminating device.

In order to maintain the operating temperature of this illuminating device at an appropriate level, a method of manufacturing a heat sink having an extended heat radiating area through the use of a metal having high thermal conductivity, to thereby couple the manufactured heat sink to an LED module, may be commonly used.

However, an extended heat sink has a finite temperature difference and a constant thermal resistance between the heat absorbing surface and the heat radiating surface thereof, due to the finite thermal conductivity of a material used therefor. The temperature difference and thermal resistance may therefore cause an unnecessary rise in temperature in an LED illuminating device. In the case of manufacturing a heat sink having a large cross-sectional area in order to reduce the thermal resistance thereof, disadvantages such as increasing the weight and the costs of the illuminating device may be caused.

Accordingly, the necessity of providing a heat sink capable of reducing the thermal resistance between the heat absorbing surface and the heat radiating surface, while minimizing the use of a high density and expensive metal material has been raised. Furthermore, in order to maintain advantages such as a long illuminating device lifespan, a great deal of research into the structural improvement and reductions in the size and weight of the illuminating device, for more efficient heat radiation, have been undertaken.

SUMMARY OF THE INVENTION

An aspect of the present invention provides an illumination device, having a simplified structure and improved heat radiation efficiency to allow for an increase in the light output of a light emitting device, whereby the effective lifespan and reliability thereof may be improved.

According to an aspect of the present invention, there is provided an illuminating device, including: a light source unit including a substrate and one or more light emitting devices mounted on the substrate; and a heat radiating unit including a sealed inner space into which a working fluid is injected, the working fluid being evaporated and condensed within the inner space due to heat of the light source unit, and emitting the heat of the light source unit to the outside through repeated phase changes according to evaporation and condensation of the working fluid.

The heat radiating unit may include: a heat absorbing surface having the light source unit mounted thereon; an inner side surface having one end connected to a center of the heat absorbing surface and the other end extending upwardly from the heat absorbing surface to penetrate the inner space, thereby forming a center hole; and a heat radiating surface connecting the other end of the inner side surface with an outer circumference of the heat absorbing surface.

The heat radiating unit may be a structure which has a triangular cross sectional shape in which the heat radiating surface forms an inclined plane, based on the heat absorbing surface used as a bottom surface.

The heat radiating surface may include a plurality of heat radiating fins protrudedly formed on an outer surface thereof.

The heat absorbing surface may include micro-channels on a surface thereof exposed to the inner space.

The illuminating device may further include an electrical connection unit accommodated within the center hole to supply the light source unit with an electrical signal.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
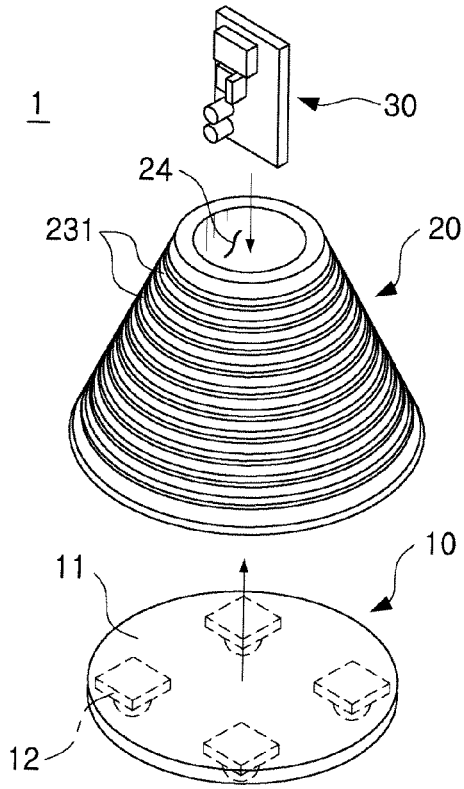
FIG. 1 is a diagram schematically illustrating an illuminating device according to an exemplary embodiment of the present invention.

Exemplary embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. While those skilled in the art could readily devise many other varied embodiments that incorporate the teachings of the present invention through the addition, modification or deletion of elements, such embodiments may fall within the scope of the present invention.

In the drawings, the shapes and sizes of components are exaggerated for clarity. The same or equivalent elements are referred to by the same reference numerals throughout the specification.

Referring to FIGS. 1 through 6, an illuminating device according to an exemplary embodiment of the present invention will be explained.

Figure 2:
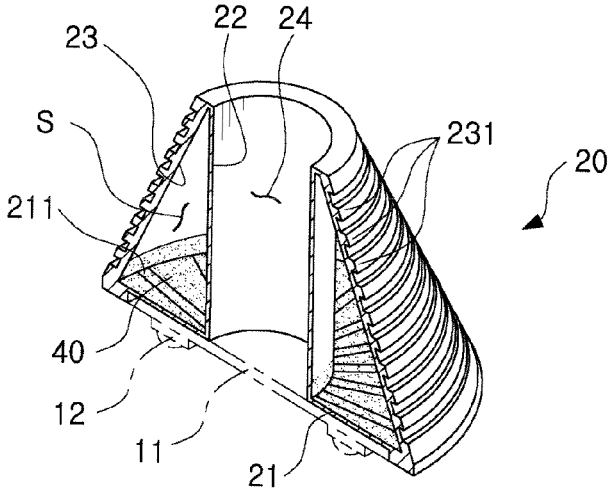
FIG. 2 is a diagram schematically illustrating a heat radiating unit in the illuminating device of FIG. 1.
Figure 3:
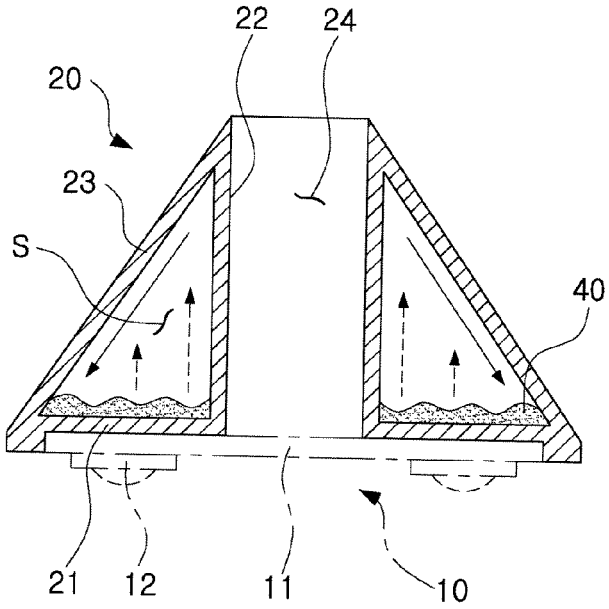
FIG. 3 is a diagram schematically illustrating the radiating principal of heat in the heat radiating unit of FIG. 2.
Figure 4:
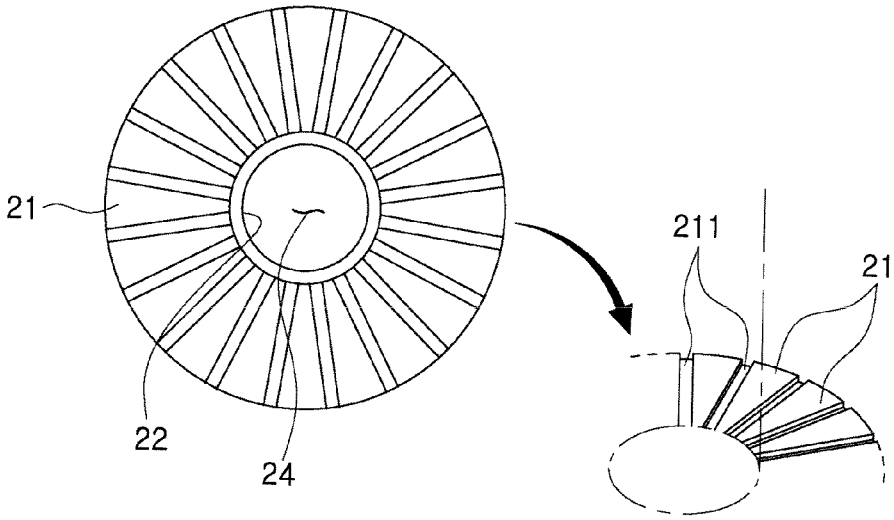
FIG. 4 is a diagram schematically illustrating a micro-channel in the illuminating device of FIG. 1.
Figure 5:
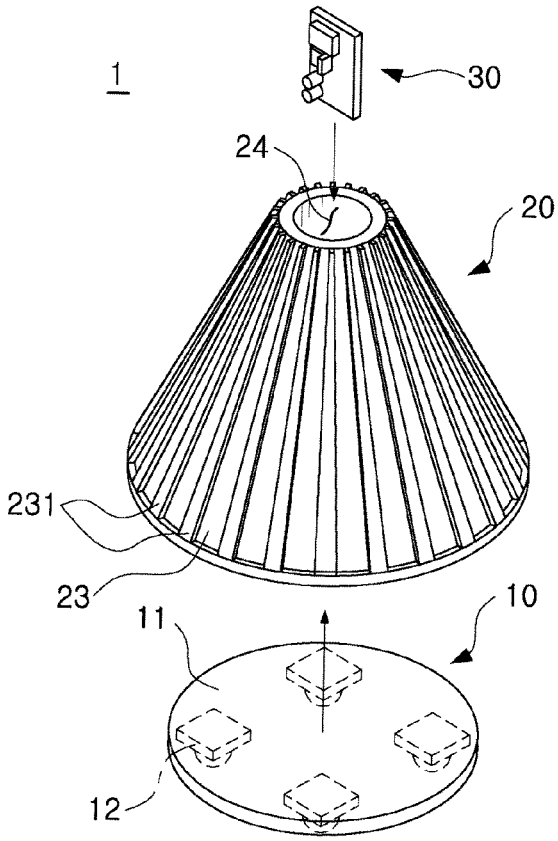
FIGS. 5 and 6 are diagrams schematically illustrating modified examples of a heat radiating unit in the illuminating device of FIG. 1.
Figure 6:
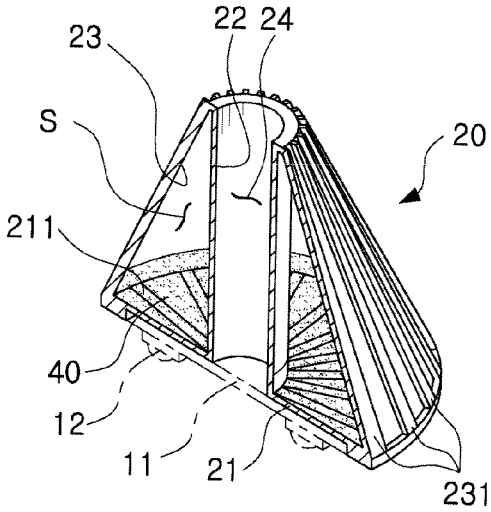

FIG. 1 is a diagram schematically illustrating an illuminating device according to an exemplary embodiment of the present invention. FIG. 2 is a diagram schematically illustrating a heat radiating unit in the illuminating device of FIG. 1. FIG. 3 is a diagram schematically illustrating the radiating principal of heat in the heat radiating unit of FIG. 2. FIG. 4 is a diagram schematically illustrating a micro-channel in the illuminating device of FIG. 1. FIGS. 5 and 6 are diagrams schematically illustrating modified examples of a heat radiating unit in the illuminating device of FIG. 1.

Referring to FIGS. 1 through 6, an illuminating device 1 according to an exemplary embodiment of the present invention may be configured to include a light source unit 10 generating light and a heat radiating unit 20 cooling the light source unit 10, and may further include an electrical connection unit 30 supplying the light source unit 10 with an electrical signal.

The light source unit 10 may include a substrate 11 and one or more light emitting devices 12 mounted on the substrate 11.

The light emitting device 12, a kind of semiconductor device emitting light of a predetermined wavelength through an electrical signal applied from the outside, may include an LED chip itself and an LED package having the LED chip mounted thereon. The LED chip may be larger than a general LED chip. The light emitting device 12 may include a single high output LED chip having improved light emitting efficiency or a single LED package having the LED chip mounted thereon. In addition, the light emitting device 12 may include a plurality of LED chips or a multi-chip package on which a plurality of LED chips are mounted.

The substrate 11, a kind of printed circuit board (PCB) may be made of an organic resin material containing epoxy, triazine, silicon, polyimide, or the like, and other organic resin materials, a ceramic material, such as AlN, $Al_2O_3$ or the like or metal and metal compound materials. In particular, the substrate 11 may be a metal core printed circuit board (MCPCB), a type of metal PCB, in view of heat radiation.

The substrate 11 having the light emitting device 12 mounted thereon may be provided with a circuit wire (not shown) electrically connected with the light emitting device 12 and an insulating layer having withstand voltage characteristics (not shown).

The heat radiating unit 20 may act as a housing supporting the light source unit 10 such that the light source unit 10 is mounted thereon to be fixed thereto, and may act as a heat sink radiating heat generated from the light source unit 10 to the outside. The heat radiating unit 20 may be made of a metal material having superior thermal conductivity in order to smoothly radiate heat.

As shown in FIGS. 1 through 6, the heat radiating unit 20 may include a sealed inner space s having a vacuum therein, into which a working fluid 40 is injected, the working fluid 40 being evaporated and condensed within the inner space s due to the heat of the light source unit 10, and may emit the heat of the light source unit 10 to the outside through repeated phase changes according to evaporation and condensation of the working fluid 40. The heat radiating unit 20 according to the exemplary embodiment of the present invention may realize a heat sink having low thermal resistance through the application of a thermosiphon system thereto.

The thermosiphon system may be formed by injecting a single fluid composition into a sealed container having a vacuum therein, and may have a structure in which, when heat is transferred from a heat source located at a lower portion of the thermosiphon system, the working fluid in the container may be evaporated and rise, and the risen working fluid in a gaseous phase may contact a low temperature heat radiating surface to be re-condensed and then flow downwardly down the low temperature heat radiating surface. Such a thermosiphon system may be advantageous in that it has a simple structure and may be stably operated constantly when the heat source is located at a position lower than that of a (low temperature) condensation part with respect to a gravitational direction.

FIGS. 2 and 3 are diagrams schematically illustrating the heat radiating unit 20 according to a thermosiphon method according to an exemplary embodiment of the present invention, and schematically show a structure of the heat radiating unit 20 applied to a bulb type illuminating device. As in FIGS. 2 and 3, the heat radiating unit 20 may include a heat absorbing surface 21 having the light source unit 10 mounted thereon, an inner side surface 22 having one end connected to the center of the heat absorbing surface 21 and the other end extending upwardly from the heat absorbing surface 21 to penetrate the inner space s, thereby forming a center hole 24, and a heat radiating surface 23 connecting the other end of the inner side surface 22 with an outer circumference of the heat absorbing surface 21. This heat radiating unit 20 may be a structure which has a triangular cross sectional shape in which the heat radiating surface 23 forms an inclined plane based on a bottom surface, the heat absorbing surface 21, thereby having an overall conical shape. In the heat radiating unit 20 having such a structure, the heat radiating surface 23 and the inner side surface 22 are integrally formed by a method, such as casting or the like, and the heat absorbing surface 21 is attached to a body thereof having a void interior, through welding or soldering.

The light source unit 10 corresponding to a heat source may be mounted on an outer surface, that is, a bottom surface of the heat absorbing surface 21, a lower portion of the heat radiating unit 20. The heat absorbing surface 21 may have a circular shape corresponding to the light source unit 10, and the heat absorbing surface 21 and the light source unit 10 may be coupled to each other by using a thermal pad, a phase change material, or a thermal interface material (not shown), such as thermal tape or the like, in order to minimize thermal resistance. Though not illustrated in the drawings, the light source unit 10 may be coupled to the heat absorbing surface 21 by a mechanical coupling element, that is, a screw.

The inner space s of the heat radiating unit 20 formed upwardly of the heat absorbing surface 21 may correspond to a space formed by surrounding the heat absorbing surface 21, the inner side surface 22, and the heat radiating surface 23, and may be formed along the circumference of the center hole 24 penetrating the center of the heat radiating unit. The inner space s may be a sealed space having a vacuum therein and may have a certain amount of the working fluid 40 injected thereinto. By doing so, the heat radiating unit 20 may have a thermosiphon structure.

The working fluid 40 may be determined on an allowable operating temperature range of the illuminating device 1. As a common room temperature working fluid 40, ethanol, methanol, acetone, distilled water or the like may be used. In the selection of the working fluid 40, the compatibility thereof, with regard to the metal material of the heat radiating unit 20, should be considered. For example, distilled water may not be used with regard to an aluminum material. It is because that a chemical reaction occurs to thereby generate hydrogen gas when distilled water is used with regard to an aluminum material. Meanwhile, the injection amount of working fluid 40 may be calculated to a degree such that the working fluid 40 will not dry out, even in the case of the worst conditions therefor, and should be injected with consideration to the inclination of the illuminating device 1 with respect to a gravitational direction such that the heat absorbing surface 21 may be constantly in contact with a working fluid 41 in a liquid phase. In particular, the heat absorbing surface 21 may include micro-channels 211 on a surface thereof exposed to the inner space s, whereby wettability of the working fluid 40 in a liquid phase may be increased. These micro-channels 211 may be formed such that they traverse the entire heat absorbing surface 21, and the wettability of the working fluid 40 on the heat absorbing surface 21 may be increased as a width of the micro-channels 21 narrows.

The heat radiating surface 23 connected to the outer circumference of the heat absorbing surface 21 while having an inclined structure may have the cross section of an inclined plane as shown in the drawings, whereby vapor of a working fluid 42 in a gaseous phase, evaporating and rising from the heat absorbing surface 21, the lower portion of the heat radiating unit 20 may directly and evenly come into contact with the heat radiating surface 23 having a low temperature. In addition, the heat radiating surface 23 may include a plurality of heat radiating fins 231 protrudedly formed on an outer surface of the heat radiating surface. The heat radiating fins 231 may be provided to be horizontal to the heat absorbing surface 21 as shown in FIG. 1. In addition, the heat radiating fins 231 may be provided to be vertical to the heat absorbing surface 21 as shown in FIGS. 5 and 6. By doing so, a heat radiating area may be increased, whereby heat radiating efficiency may be improved.

In this manner, the heat radiating unit 20 according to a thermosiphon method may absorb heat generated from the light source unit 10 through the heat absorbing surface 21 provided on the lower portion thereof. The working fluid 41 in a liquid phase provided on the surface of the heat absorbing surface 21 due to the absorbed heat may evaporate and rise. The risen working fluid 42 in a gaseous phase may contact the heat radiating surface 23 having a low temperature to be re-condensed and then flow down downwardly from the heat absorbing surface 21, the lower portion of the heat radiating unit 20. In this case, entrainment due to interference between the working fluid 41 in a liquid phase and the working fluid 41 in a gaseous phase may be of concern. However, in general, since a difference in temperature between an evaporation part (heat absorbing surface) and the condensation part (heat radiating surface) is not large when radiation dependent on natural convection is used on the heat radiating surface 23, the velocity of the working fluid 42 in a gaseous phase is also relatively low.

Thus, consideration of the entrainment between the two phases may not be required. In addition, since the inner space in the proximity of the heat absorbing surface 21 from which the working fluid 40 evaporates is in a thermodynamically saturated state, a temperature distribution on the heat absorbing surface 21 is uniformly maintained, whereby the light source unit 10 mounted on the heat absorbing surface 21 may secure isothermality. Furthermore, since the majority of the inner space s may be used as a transfer path of the working fluid 42 in a gaseous phase, heat transfer limitation, that is, chocking due to excessive evaporation of the working fluid 40 may be prevented.

The electrical connection unit 30 may include a power supply unit (PSU) or the like, and may be accommodated within the center hole 24 to supply the light source unit 10 with an electrical signal from the outside. Furthermore, a socket (not shown) covering the center hole 24 may be further mounted on the terminal of the heat radiating unit 20, and a diffuser (not shown) may be mounted on the light source unit 10.

As set forth above, according to exemplary embodiments of the invention, thermal resistance between the heat absorbing surface contacting the heat source and the heat radiating surface emitting heat may be minimized.

In addition, the majority of the inner space of the heat radiating unit may be a void having a vacuum therein, thereby being allowing for weight reduction, as compared to an existing heat sink having a solid interior, whereby an effective reduction in the weights and production costs of the heat radiating unit and the illuminating device may be realized.

The inner space of the heat radiating unit may be used as the transfer path of the working fluid in a gaseous phase according to a thermosiphon method, whereby heat transfer limitation (chocking) due to excessive evaporation of the working fluid may be prevented, and further, the light emitting device may secure isothermality due to the heat absorbing surface in a thermodynamically saturated state.

While the present invention has been shown and described in connection with the exemplary embodiments, it will be apparent to those skilled in the art that modifications and variations can be made without departing from the spirit and scope of the invention as defined by the appended claims.

What is claimed is:

1. An illuminating device, comprising:

a light source unit including a substrate and one or more light emitting devices disposed on the substrate; and a heat radiating unit including a sealed inner space into which a working fluid is injected, the sealed inner space having a center hole penetrating the sealed inner space, the working fluid being evaporated and condensed within the inner space due to heat of the light source unit, such that the heat radiating unit emits the heat of the light source unit to the outside through repeated phase changes according to evaporation and condensation of the working fluid.

2. The illuminating device of claim 1, wherein the heat radiating unit further includes:

a heat absorbing surface having the light source unit disposed thereon;

an inner side surface having one end connected to a center of the heat absorbing surface and the other end extending upwardly from the heat absorbing surface to penetrate the inner space, thereby forming the center hole; and a heat radiating surface connecting the other end of the inner side surface with an outer circumference of the heat absorbing surface.

3. The illuminating device of claim 2, wherein the heat radiating unit has a triangular cross sectional shape in which the heat radiating surface forms an inclined plane, based on the heat absorbing surface as a bottom surface.

4. The illuminating device of claim 2, wherein the heat radiating surface includes a plurality of heat radiating fins protrudedly disposed on an outer surface of the heat radiating surface.

5. The illuminating device of claim 3, wherein the heat radiating surface includes a plurality of heat radiating fins protrudedly disposed on an outer surface of the heat radiating surface.

6. The illuminating device of claim 2, wherein the heat absorbing surface includes micro-channels on a surface of the heat absorbing surface exposed to the inner space.

7. The illuminating device of claim 3, wherein the heat absorbing surface includes micro-channels on a surface of the heat absorbing surface exposed to the inner space.

8. The illuminating device of claim 2, further comprising an electrical connection unit accommodated within the center hole to supply the light source unit with an electrical signal.

9. An illuminating device, comprising:

a light source unit including a substrate and one or more light emitting devices disposed on the substrate; and a heat radiating unit including a sealed inner space into which a working fluid is injected, the working fluid being evaporated and condensed within the inner space due to heat of the light source unit, and emitting the heat of the light source unit to the outside through repeated phase changes according to evaporation and condensation of the working fluid, wherein:

the heat radiating unit further includes:

a heat absorbing surface having the light source unit disposed thereon;

an inner side surface having one end connected to the heat absorbing surface and the other end extending upwardly from the heat absorbing surface; and a heat radiating surface connecting the other end of the inner side surface with an outer circumference of the heat absorbing surface, and the heat radiating unit is a structure which has a triangular cross sectional shape in which the heat radiating surface forms an inclined plane, based on the heat absorbing surface used as a bottom surface.

10. The illuminating device of claim 9, wherein the heat radiating surface includes a plurality of heat radiating fins protrudedly formed on an outer surface thereof

11. The illuminating device of claim 3, wherein the heat absorbing surface includes micro-channels on a surface thereof exposed to the inner space.

* * * * *